US011428060B1

(12) United States Patent
Murphy et al.

(10) Patent No.: US 11,428,060 B1
(45) Date of Patent: Aug. 30, 2022

(54) HIGH-EXPANSION ANCHOR SLIP ASSEMBLY FOR WELL TOOL

(71) Applicant: Halliburton Energy Services, Inc., Houston, TX (US)

(72) Inventors: Robert Travis Murphy, Van Alstyne, TX (US); Terapat Apichartthabrut, Plano, TX (US); Abdel Hamid Rawhi Abeidoh, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/170,286

(22) Filed: Feb. 8, 2021

(51) Int. Cl.
*E21B 23/06* (2006.01)
*E21B 33/129* (2006.01)

(52) U.S. Cl.
CPC ..... *E21B 23/06* (2013.01); *E21B 33/129* (2013.01)

(58) Field of Classification Search
CPC ..... E21B 23/06; E21B 33/129; E21B 23/01; E21B 33/1208; E21B 33/1293; E21B 23/00; E21B 43/105
See application file for complete search history.

(56) References Cited

U.S. PATENT DOCUMENTS

| | | | | |
|---|---|---|---|---|
| 5,566,762 | A | 10/1996 | Braddick et al. | |
| 7,779,910 | B2 | 8/2010 | Watson | |
| 8,936,102 | B2 | 1/2015 | Rood | |
| 2003/0226668 | A1 | 12/2003 | Zimmerman et al. | |
| 2012/0298379 | A1* | 11/2012 | Van Riet | E21B 43/103 166/208 |
| 2014/0209325 | A1 | 7/2014 | Dockweiler et al. | |
| 2017/0370176 | A1* | 12/2017 | Frazier | E21B 33/1212 |

FOREIGN PATENT DOCUMENTS

| | | | | |
|---|---|---|---|---|
| EP | 1030031 | | 8/2000 | |
| NO | 20151175 | A1 * | 3/2016 | |
| WO | 2014-044630 | | 3/2014 | |
| WO | WO-2015130419 | A1 * | 9/2015 | E21B 33/129 |
| WO | WO-2017151384 | A1 * | 9/2017 | E21B 23/01 |

OTHER PUBLICATIONS

International Search Report and Written Opinion for Application No. PCT/US2021/018814, dated Oct. 29, 2021.

* cited by examiner

*Primary Examiner* — Daniel P Stephenson
(74) *Attorney, Agent, or Firm* — Scott Richardson; C. Tumey Law Group PLLC

(57) ABSTRACT

A high-expansion slip/wedge system may include at least one slip and actuatable wedge disposable about the mandrel. The actuatable wedge includes an actuator ramp configured to urge the slip radially outwardly in response to axial movement of the actuatable wedge in direct engagement with the slip ramp. A wedge extender, which may be part of a kit, is removably disposable along the mandrel intermediate the slip ramp and actuatable wedge to support increased expansion. The wedge extender may include an inwardly facing ramp engageable by the actuatable wedge and an outwardly facing ramp for engaging the slip ramp. The wedge extender provides additional engagement area for supporting and optionally increasing the amount of radial expansion.

13 Claims, 8 Drawing Sheets

HIGH-EXPANSION ANCHOR SLIP ASSEMBLY FOR WELL TOOL

BACKGROUND

In preparing subterranean wells for production, a sealing system such as a well packer may be run into the well on a work string or a production tubing, optionally with other completion equipment, such as a screen adjacent to a producing formation. The packer may be used to seal the annulus between the outside of the production tubing and the inside of the well casing to block movement of fluids through the annulus past the packer location. The packer may include anchor slips that cooperate with complementary wedging surfaces to radially extend the anchor slips into gripping engagement against the well casing bore. The packer also carries annular seal elements which are expandable radially into sealing engagement against the bore of the well casing.

One challenge to packer design is that the forces involved in setting the packer may deform the casing. The loading of slips onto the casing wall can deform the casing into a predisposed slip pattern corresponding to the number of individual slips used. Nodes will sometimes appear on the casing outer diameter corresponding to each slip segment, for example. This may interfere with subsequent attempts to land and properly set another packer after the first one is removed. Further, the tubing in such wells is typically made of an expensive, corrosion-resistant alloy, and scratches and indentations can act as stress risers or corrosion points. Conventional slip-wedge systems are also limited in the amount they can expand to engage the casing ID or open-hole bore, as too large a wedge diameter may permanently deform the slip during installation or may not clear the smallest diameter of tubular profile.

BRIEF DESCRIPTION OF THE DRAWINGS

These drawings illustrate certain aspects of some of the embodiments of the present disclosure and should not be used to limit or define the method.

DETAILED DESCRIPTION

This disclosure describes an anchor slip assembly for a well tool having a wedge extender that supports radial expansion of a slip. The wedge extender may be included with the anchor slip assembly or as part of an extension kit. In one aspect, use of the wedge extender may improve support for a given range of radial expansion. In another aspect, use of the wedge extender optionally allows for increased radial expansion, as part of a "high expansion" slip/wedge system. For example, a barrel slip may be expanded further using the wedge extender than what would typically be achievable by a traditional slip/wedge system of similar nominal dimensions. This solution may, for instance, allow production packers to engage and anchor in casing weight ranges larger than what is typically achievable. The wedge extender may also provide a larger engagement area (bearing surface) for supporting radial loads.

In one or more example configurations, the anchor slip assembly includes a first slip and a first actuatable wedge disposable on a mandrel. The actuatable wedge may be actuated for setting the tool with or without the wedge extender installed on the mandrel. The slip has an inwardly facing slip ramp and the actuatable wedge has an outwardly facing actuator ramp directly engageable with the slip ramp when the wedge extender is not installed. The wedge extender has an outwardly facing ramp for engaging the slip ramp and an inwardly facing ramp for engaging the actuator ramp when the wedge extender is installed.

The anchor slip assembly allows the well tool to be set in different hole sizes or different ranges of hole sizes depending on whether the wedge extender is used. The tool may be set in a first hole diameter or range of hole diameters without the wedge extender, and in a second (e.g., larger) hole diameter or range of hole diameters when the wedge extender is added. The wedge extender may provide increased support for a given hole size and/or increased radial expansion for setting in larger holes. The extension kit may include the wedge extender and, optionally, a second slip and/or actuatable wedge to accommodate the wedge extender.

Figure 1:
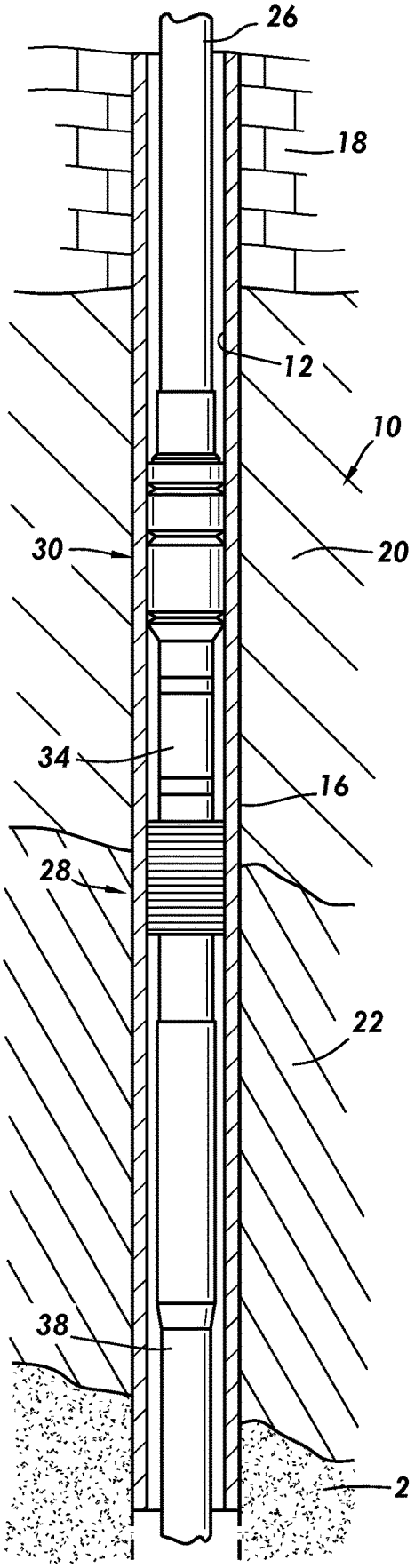
FIG. 1 is an elevation view of a representative well tool secured downhole by an anchor slip assembly according to the present disclosure.

FIG. 1 is an elevation view of a representative well tool 10 secured downhole within a tubular member 16 by an anchor slip assembly 28 according to the present disclosure. The anchor slip assembly 28, as further explained below, may allow the tool 10 to be set within a larger diameter and/or within a larger range of diameters than might ordinarily be practicable for a conventional tool of similar nominal size (e.g., same nominal mandrel diameter, etc.). It will be understood that any of a variety of well tools may be secured downhole within any suitable tubular member with an anchor slip assembly 28 according to this disclosure. By way of example, the well tool 10 in FIG. 1 is embodied as a well packer 10, and the tubular member in which it is set is a tubular well casing 16. The casing 16 lines a well bore 12, which has been drilled through multiple stratigraphic layers 18, 20 and 22 of the earth, down to and including a hydrocarbon bearing formation 2. The packer 10 may be lowered into the well bore 12 on a tubing string, which may comprise the tubing string 26 shown, and is secured in the desired position within the casing 16 by the anchor slip assembly 28 as further discussed below. The packer 10 is then sealed to the casing 16 with a seal element assembly 30 axially spaced from the anchor slip assembly 28.

The packer 10 includes a mandrel 34 for supporting various components thereon. The mandrel 34 is connected to the tubing string 26, which extends to a wellhead at the ground level (aka "surface") of the well site, for conducting produced fluids from the hydrocarbon bearing formation 2 to the surface. The lower end of the casing 16, which intersects the hydrocarbon bearing formation 2, may be perforated to allow well fluids such as oil and gas to flow from the hydrocarbon bearing formation 2 through the casing 16 into the well bore 12. The packer 10 in this example is releasably set by the anchor slip assembly 28, meaning the packer has the ability for the anchor slip assembly 28 to be subsequently released later to retrieve the packer 10 if needed. The seal element assembly 30, also mounted on the mandrel 34, is expanded against the well casing 16 for providing a fluid tight seal between the mandrel and the well casing, so that formation pressure is held in the well bore 12 below the seal assembly. That way, formation fluids are forced into the bore of the packer 10 to flow to the surface through the production tubing string 26. The anchor slip assembly 28 may be set by axial actuation of certain components on the mandrel, e.g., via hydraulic actuation, as further discussed below. The seal element assembly 30 may be similarly set by axial actuation.

Figure 2A:
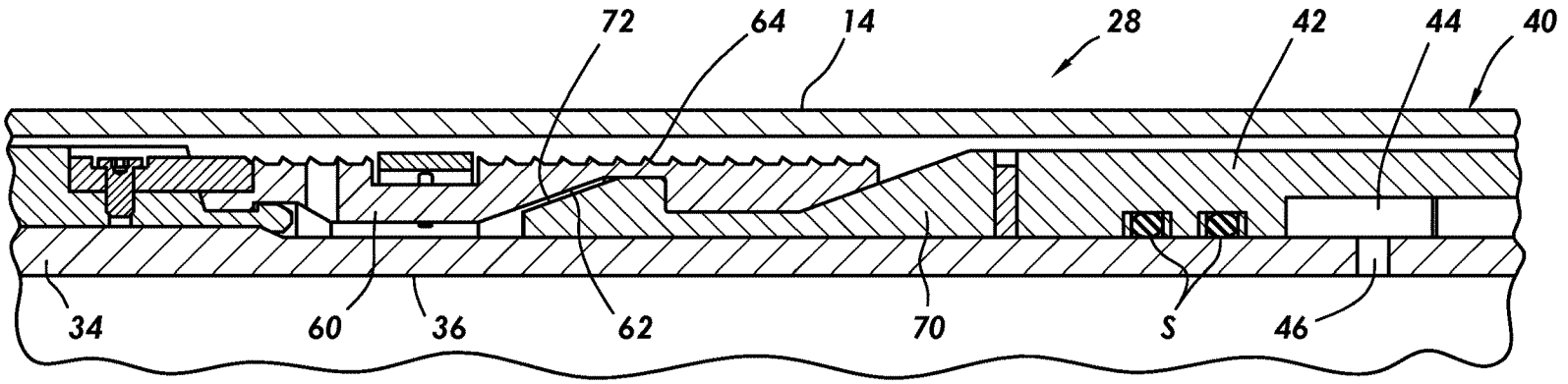
FIG. 2A is an example configuration of the anchor slip assembly of FIG. 1.
Figure 2B:
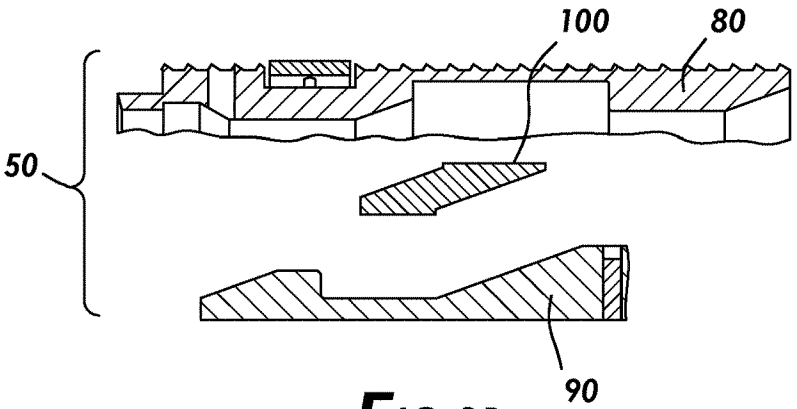
FIG. 2B is an exploded view of an extension kit for use with the anchor slip assembly of FIG. 2A.
Figure 2C:
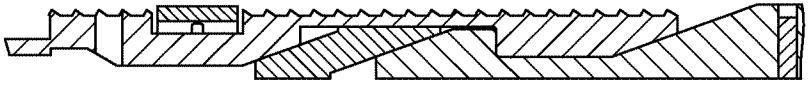
FIG. 2C is an assembled view of the extension kit components of FIG. 2B.

FIGS. 2A-2C illustrate an example embodiment of the anchor slip assembly 28 of FIG. 1 and an optional extension kit for use therewith. FIG. 2A is a sectional view of the anchor slip assembly 28 of FIG. 1 without the extension kit installed. FIG. 2B is an exploded view showing separate components of the extension kit 50. FIG. 2C shows the assembled components of the extension kit 50. Referring to these figures together, a first slip 60 and first actuatable wedge 70 are installed on a mandrel 34, which may be of typical slip and actuator dimensions for a tool of this nominal size. An extension kit 50 is also provided, such as for use with larger hole sizes or an increased range of hole sizes. The extension kit 50 at least includes a wedge extender 100 for supporting radial extension of the first slip 60 or another slip. The extension kit 50 in this example configuration also includes a second slip 80 and second actuatable wedge 90 for when using the wedge extender 100. The first slip 60 and actuatable wedge 70 may be of a standard length suitable for use even without the extension kit 50. In this example, the second slip 80 and actuatable wedge 90 are interchanged with the respective first slip 60 and actuatable wedge 70 when using the wedge extender 100 of the extension kit 50. The second slip 80 and actuatable wedge 90 may be either the same or different geometry or proportions, such as to accommodate an increased length of the wedge extender 100 and to support an increased range of radial expansion.

In FIG. 2A, the anchor slip assembly 28 is shown with the first slip 60 and actuatable wedge 70 in a run-in position, prior to setting the slip 60 against the casing 14. The slip 60 includes an outwardly facing casing engagement portion 64 for engagement with the casing 14, and an inwardly facing slip ramp 62. The actuatable wedge 70 includes an outwardly facing actuator ramp 72 in direct sliding engagement with the inwardly facing slip ramp 62.

The anchor slip assembly 28 is settable within the casing 14 using an actuator assembly 40, which is hydraulically operated in this example, but which could alternatively be controlled by mechanical or electronic actuators, hydrostatic setting, or any other suitable actuation type. The mandrel 34 has a cylindrical bore 36 defining a longitudinal production flow passage for flow of fluid to or from the surface of the well site. The actuator assembly 40 includes a piston 42 concentrically mounted on the mandrel 34 below the anchor slip assembly 28. The piston 42 directly or indirectly engages, and may be coupled to, the actuatable wedge 70. The piston 42 carries annular seals "S" in sealing engagement against the external surface of the mandrel 34. The piston 42 encloses an annular chamber 44, which is open to the cylindrical bore 36 at an inlet port 46. Hydraulic pressure may be applied through the cylindrical bore 36 to the inlet port 46 to pressurize the annular chamber 44 and urge the piston 42 axially toward (upward, in this example) the actuatable wedge 70. The piston 42 is thereby shifted into axial engagement with the actuatable wedge 70, urging the outwardly facing actuator ramp 72 into direct engagement with the inwardly-facing slip ramp 62. Although the present discussion focuses on setting of the anchor slip assembly 28, the actuator assembly 40 or another actuator may be used to actuate the seal element assembly 30 of FIG. 1.

Figure 3:
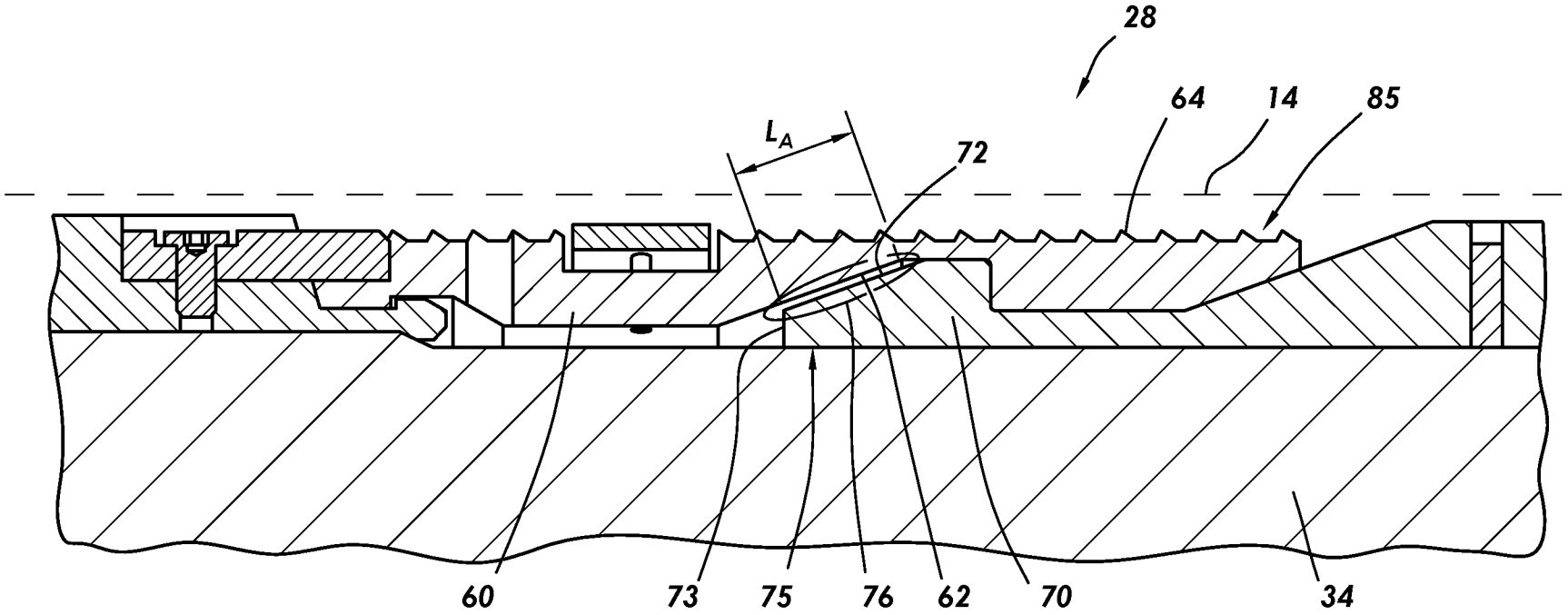
FIG. 3 is a detailed view of the anchor slip assembly of FIG. 2A in a run-in position without the extension kit.

FIG. 3 is a detailed view of the anchor slip assembly 28 in a run-in position, without the extension kit 50 of FIG. 2B. Therefore, the first (e.g., standard length) slip 60 and actuatable wedge 70 are installed on the mandrel 34 in their run-in position. The slip 60 is in a radially retracted position as run in, with the casing-engagement portion 64 of the slip 60 spaced radially inward of the ID of the casing 14 (indicated in dashed line type). An interface between the slip ramp 62 and actuator ramp 72 may be referred to as the inner hump 75. The leading edge 73 of the actuatable wedge 70 in this embodiment is blunted, i.e., with the leading corner cut off or omitted, as the sharp corner of material removed or omitted would otherwise be prone to damage. Thus, a length $L_A$ of the actuator ramp 72 is slightly shorter than the length of the slip ramp 62 it engages. Still, the area of an engagement 76 between the slip ramp 62 and actuator ramp 72 at this inner hump 75 is well supported in this run-in position, in that the actuator ramp 72 and slip ramp 62 are in direct contact along the entirety of the surface of the actuator ramp 72, and along most of the length of the slip ramp 62, with no appreciable overhang of one with respect to the other. Another pair of engaging wedge surfaces between the slip 60 and actuatable wedge 70, referred to as the outer hump 85, are also well supported in this position without appreciable overhang of one with respect to the other.

Figure 4:
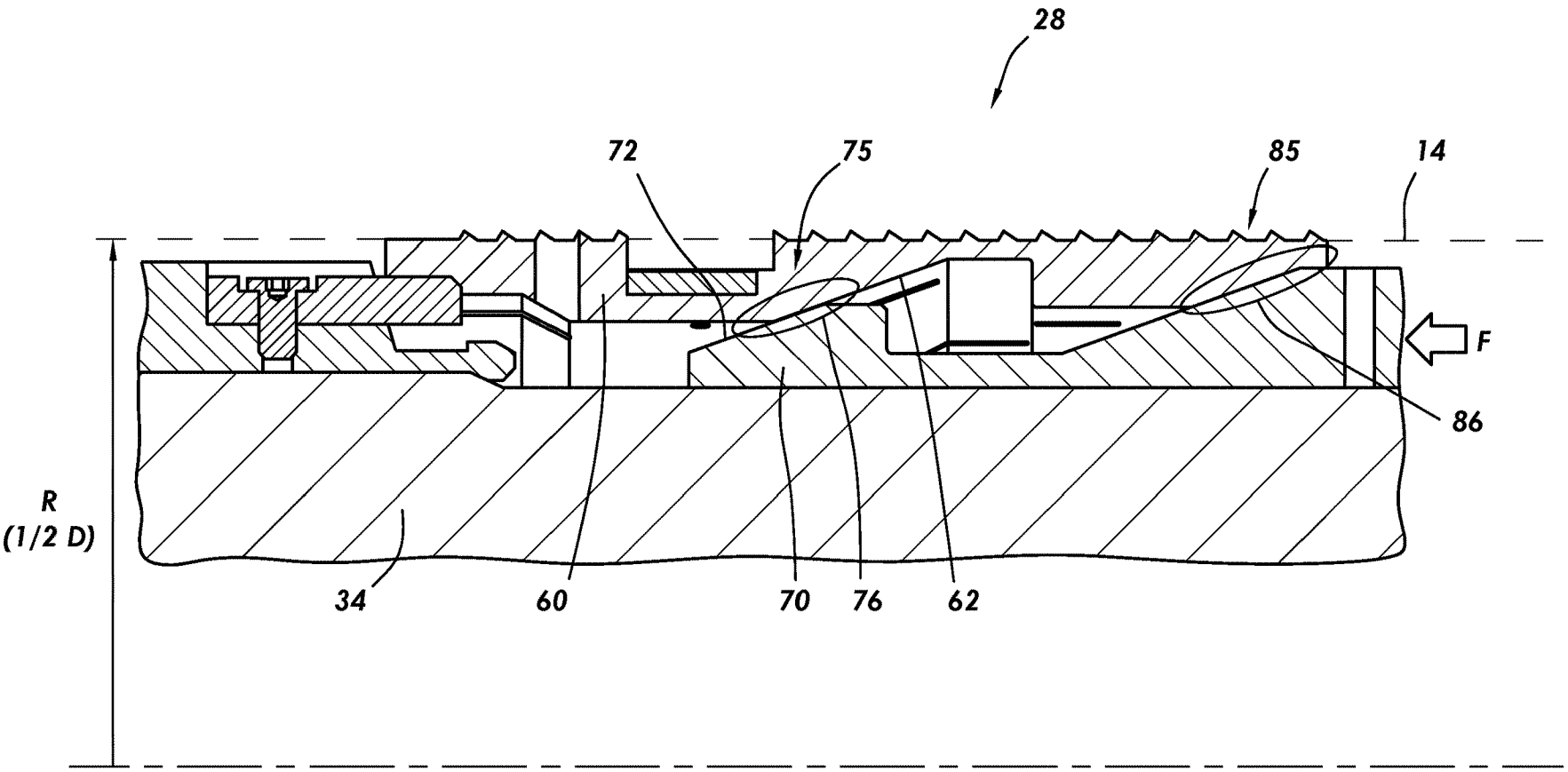
FIG. 4 is a detailed view of the anchor slip assembly of FIG. 3 in a set position.

FIG. 4 is a detailed view of the anchor slip assembly 28 having been moved from the run-in position of FIG. 3 to a set position by an axial engagement force "F" driving axial movement of the actuatable wedge 70. In the set position, the casing-engagement portion 64 of the slip 60 has been radially extended into biting engagement with the ID of the casing 14. The casing 14 has a radius labeled "R" (i.e., half of its inner diameter "D") in FIG. 4. As illustrated, the standard-length slip 60 and actuatable wedge 70 do have sufficient length to move the slip 60 into engagement with the casing 14 of the diameter shown. Also, at least an engagement 86 at the outer hump 85 is still well supported. However, there is now reduced engagement 76 at the inner hump 75 between the slip ramp 62 and actuator ramp 72 in this set position, with some overhang of the actuator ramp 72 beyond the slip ramp 62. The reduced length and area of engagement 76 between the slip ramp 62 and actuator ramp 72 may generate higher contact stresses and stress concentration along edge of slip ramp 62 and actuator ramp 72. The standard-length slip 60 and actuator 70 may still be able to set against this casing diameter in this example, depending on the setting force required versus the mechanical properties (e.g., material strength and geometry) of the structure. However, there is a limit to how large of a diameter the anchor slip assembly 28 will be capable of setting when using the standard length slip 60 and actuator 70. The extension kit 50 may thus be used, as explained below, to better support the amount of radial expansion of the slip shown in FIG. 4 and/or to support an increased radial expansion of the slip.

Figure 5:
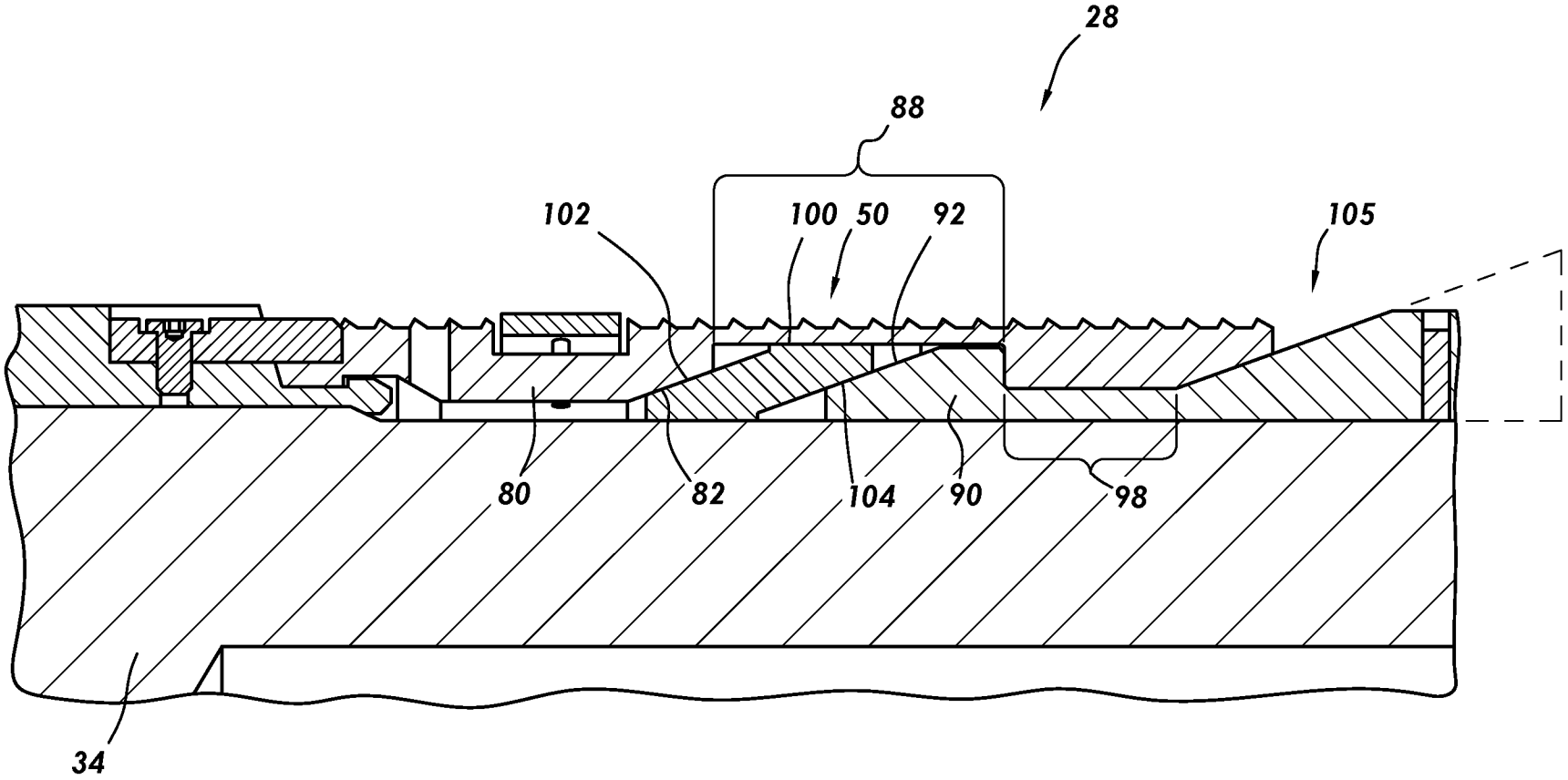
FIG. 5 is a detailed view of the anchor slip assembly in a run-in position with the extension kit installed.

FIG. 5 is a detailed view of the anchor slip assembly 28 in a run-in position, but with the extension kit 50 installed. The second slip 80 and actuatable wedge 90 are installed on the mandrel 34 in place of the slip 60 and actuatable wedge 70 of FIG. 3, and the wedge extender 100 is installed therebetween. For example, the tool may have been run one or more times with the standard-length slip 60 and actuatable wedge 70 of FIG. 3 installed in a casing withing a first range of casing diameter, before removing the slip 60 and actuatable wedge 70 to install the extension kit 50 for use on casing in another range of casing diameters, including potentially larger casing diameters. With the extension kit 50 installed, the slip ramp 82 and actuator ramp 92 are not in direct contact. Rather, the slip ramp 82 contacts an outwardly facing ramp 102 of the wedge extender 100 and the actuator ramp 92 contacts an inwardly facing ramp 104 of the wedge extender 100.

The dimensions or proportions of the second slip 80 and/or the actuatable wedge 90 of the extension kit may be different than the dimensions or proportions of the first slip 60 and wedge 70, such as to accommodate the wedge extender 100 and/or the increased radial travel of the slip 80. In the FIG. 5 example, the second slip 80 include a longer neck 88 to accommodate the axial length of the actuatable wedge 90 and wedge extender 100. The actuatable wedge 90 of FIG. 5 is optionally the same as the actuatable wedge 70 of FIG. 4, and may not be required for use with this particular extension kit 50. However, the second actuatable wedge 90 could alternately also include different proportions or dimensions, such as a longer neck 98 and/or longer ramp (indicated in dashed lines) on the outer hump 105.

Figure 6:
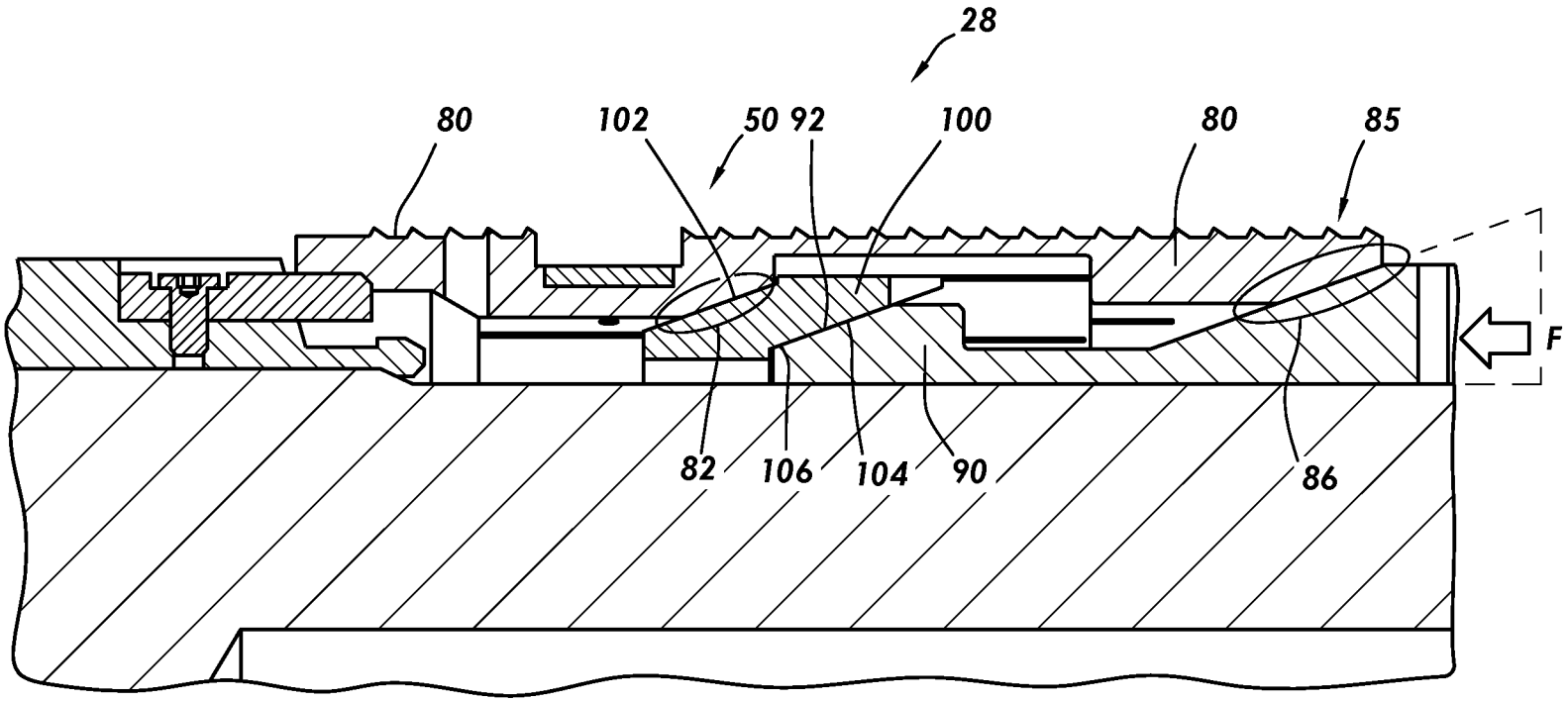
FIG. 6 is a detailed view of the anchor slip assembly of FIG. 5 in a set position.

FIG. 6 is a detailed view of the anchor slip assembly 28 of FIG. 5 moved to a set position by an axial engagement force "F." With the extension kit 50 installed, the anchor slip assembly 28 radially expands the slip 80, not by direct engagement between the actuator ramp 92 and slip ramp 82, but by a combination of one step of urging the actuatable wedge 90 axially under the wedge extender 100 to urge the wedge extender 100 radially outwardly with respect to the mandrel 34, and another step of urging the wedge extender 100 axially along the mandrel under the slip ramp 82 to urge the slip 80 radially outwardly with respect to the wedge extender 100. These two steps are an aspect of a related example method and may be performed consecutively or concurrently. Features such as travel stops described below may be used to control deployment and thus the order of the steps. Both steps contribute to urging the slip 80 radially outwardly with respect to the mandrel 34.

Assuming the same ramp angles as the FIG. 4 embodiment, the radial extension of the slip 80 in the set position of FIG. 6 may be equal or similar to the radial extension of the slip 60 in the set position of FIG. 4 for the same axial travel of the respective actuatable wedges 70, 90 along the mandrel. The wedge extender 100 provides increased area for engagement with the slip ramp and actuator wedge to support this expansion, as compared with when the slip ramp and actuator wedge are in direct engagement. This increased engagement area comprises both the inwardly facing ramp 104 and outwardly facing ramp 102 of the wedge extender 100. Specifically, the inwardly facing ramp of the wedge extender has a larger engagement area than the slip ramp and the outwardly facing ramp of the wedge extender has a larger engagement area than the actuator ramp. In part, the outwardly facing ramp 102 may have a larger engagement area for engagement with the slip ramp than is provided by the actuator ramp 72 in FIG. 4 because the outwardly facing ramp 102 of the wedge extender 100 may extend all the way from a mandrel outer diameter (OD) to a slip inner diameter (ID) in the run-in position of FIG. 5. The actuatable wedge 70 of FIG. 3, by comparison, does not extend all the way to the mandrel 34 due to the blunted end 73. This increased engagement area helps support increased expansion.

Another aspect that supports increased expansion is that the actuator ramp 92 only needs to move partially along the inwardly facing ramp 104 (half as far as the actuator ramp 72 moves along the slip ramp 62 in FIG. 4), and the slip ramp 82 only needs to move partially along the outwardly facing ramp 102 (half as far as the slip ramp 62 moves along the actuator ramp 72 in FIG. 4), to achieve the same radial displacement of the slip 80 of FIG. 6 as the slip 60 of FIG. 4. Due to the shorter required travel between engaged pairs of ramped surfaces, {82 102}, {92 104}, these surfaces remain in full engagement when moved to the set position, without the overhang like with the pair of surfaces {62 72} of FIG. 4.

In view of these above aspects, With the extension kit 50 installed, the anchor slip assembly 28 achieves a better supported engagement between sloped surfaces than in FIG. 4 for the same radial travel of the slip 80. The anchor slip assembly 28 may also achieve greater radial extension of the slip 80 and remain at least as well supported as in FIG. 4 with the extension kit 50 installed. The engagement 86 at the outer hump 85 in FIG. 6 is the same as that in FIG. 4 in this example. However, in another configuration, the sloped surfaces of the outer hump 85 may be increased in length, as shown with dashed lines, to better support further radial extension of the slip 80.

The wedge extender 100, alone or as part of the extension kit 50, supports increased radial expansion. The extension kit 50 with the included wedge extender 100, in the various configuration options, makes it possible for the anchor slip assembly 28 to be used with an expanded range of casing diameters and/or with larger casing diameters. In one aspect, the anchor slip assembly 28 may be used to set a tool within a first range of casing diameters without the extension kit 50, and within a second range of casing diameters with the extension kit 50 installed.

Figure 7:
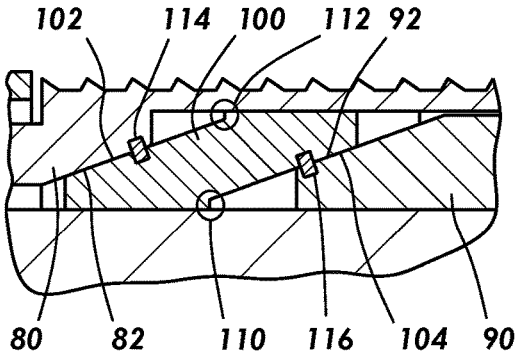
FIG. 7 is an enlarged view of the wedge extender featuring travel stops.

FIG. 7 is an enlarged view of the wedge extender 100 featuring travel stops used to limit travel of the slip ramp 82 and actuator ramp 102 with respect to the wedge extender 100. A first travel stop 110 is provided along an interface between the actuator ramp 92 and the inwardly facing ramp 104 of the wedge extender 100, limiting slidable engagement between the actuator ramp 92 and the wedge extender 100. A second travel stop 112 is provided along an interface between the slip ramp 82 and the outwardly facing ramp 102 of the wedge extender 100 limiting slidable engagement between the slip ramp 82 and the wedge extender 100. More particularly, the first travel stop 110 comprises a projection, and is disposed along the actuator ramp 92, although the first travel stop could alternatively be provided along the inwardly facing ramp 104 of the wedge extender 100. Similarly, the second travel stop 112 comprises a projection, and is disposed along the slip ramp 82 in this example, but could alternately be disposed along the outwardly facing ramp 104 of the wedge extender 100.

The projections 110, 112 in this example are embodied as tails, which may be unitarily formed with the parent material of the wedge extender 100, the actuatable wedge 90, and/or the slip 80. However, anything that limits relative movement between the actuator ramp 92 and the wedge extender 100 at the interface between the actuator ramp 92 and the inwardly facing ramp 104 of the wedge extender 100 may be used as the first travel stop 100. Likewise, anything that limits relative movement between the slip ramp 82 and the wedge extender 100 at the interface between the actuator ramp 82 and the outwardly facing ramp 102 of the wedge extender 100 may be used as the second travel stop 112. For example, instead of tails, there could be a slot on one part and a pin on the other that rides in the slot, to limit travel between these parts.

Figure 8:
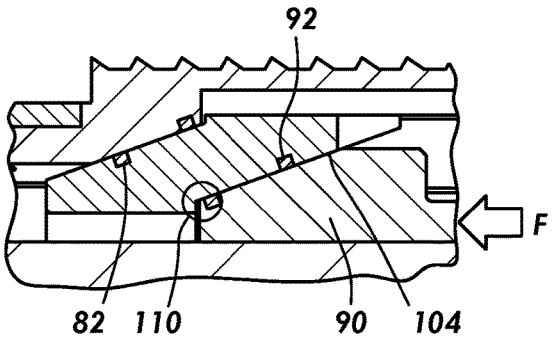
FIG. 8 is another enlarged view of the wedge extender illustrating the use of the travel stops to limit travel of the slip and actuator with respect to the wedge extender.

FIG. 8 is another detailed view of the wedge extender 100 illustrating the use of the travel stops 110, 112 to limit travel of the slip ramp 82 and actuator ramp 102 with respect to the wedge extender 100. The actuatable wedge 90, driven by the axial actuating force F, may urge the actuator ramp 92 along the inwardly facing ramp 104 of the wedge extender 100 until the actuator 92 impinges the first travel stop 110. The first travel stop 110 here is positioned to prevent the actuator ramp 92 from moving beyond (e.g., overhanging) the inwardly facing ramp 104. Likewise, the second travel stop 112 here is positioned to prevent the slip ramp 82 from moving beyond the outwardly facing ramp 102. That way, the actuator ramp 92 remains in full contact/engagement with the inwardly facing ramp 104 of the wedge extender 100 and the slip ramp 82 remains in full contact/engagement with the outwardly facing ramp 102 of the wedge extender 100. In one or more embodiments, the travel stops are positioned so that a range of sliding engagement between the actuator ramp and the wedge extender is equal to a range of sliding engagement between the slip ramp and the wedge extender.

Optional shear pins 114, 116 are also shown in FIGS. 7 and 8, which may be used to assist in timing of the deployment. In particular, a first shear pin 114 is used to initially couple the slip 80 to the wedge extender 100, and a second shear pin 116 is used to initially couple the actuatable wedge 90 to the wedge extender 100. Each shear pin requires a certain amount of force to be sheared, which may result from the axially-applied actuator force F. FIG. 7 shows the shear pins intact, in the run-in position. FIG. 8 shows the shear pins after having been sheared, in the set position.

In one example, the first shear pin 114 could be included, but not the second shear pin 116, if it is desired to control deployment so that the actuatable wedge 90 first moves and engages the first travel stop 110 before the wedge extender 100 moves to engage the second travel stop 112. Conversely, just the second shear pin 116 may be included if it is desired to control deployment so that the wedge extender 100 moves to engage the second travel stop 112 before the actuatable wedge 90 moves to engage the first travel stop 110. In another example, both shear pins 114, 116 could be used, wherein one shear pin intentionally requires a greater shear force to shear than the other. The shear pins may be omitted entirely if there is no desire to control the order of deployment.

Figure 9:
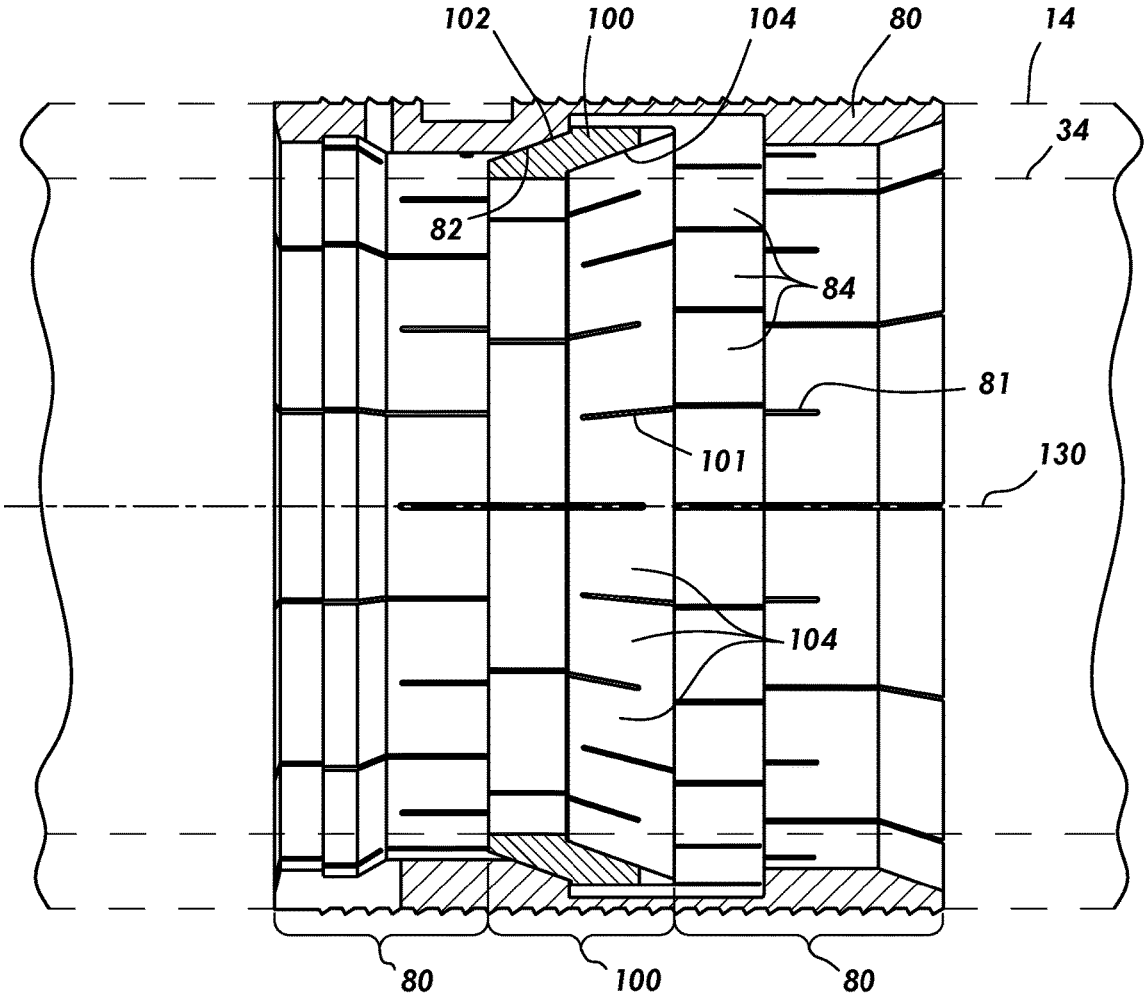
FIG. 9 is a cross-sectional side view of a full barrel slip and wedge extender featuring expansion slots on the barrel slip and wedge extender.
Figure 10:
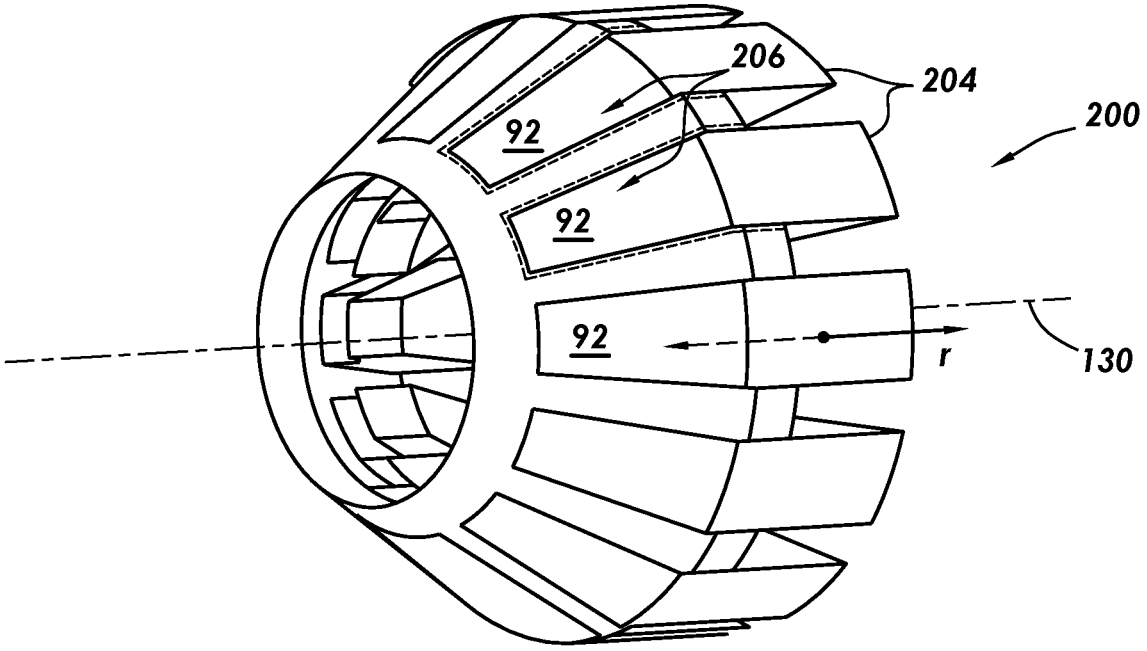
FIG. 10 is a perspective view of an alternate configuration of a wedge extender featuring wedge extender segments slidably received within radially-extending tracks.
Figure 11:
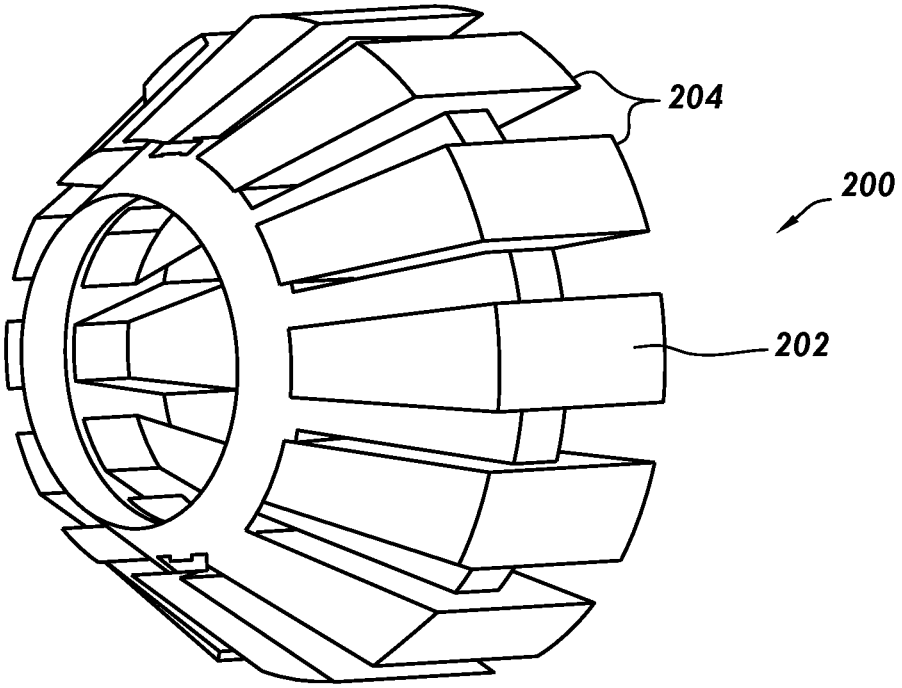
FIG. 11 is a perspective view of the wedge extender of FIG. 10, with the wedge extender segments urged radially outwardly.

The preceding figures illustrate a number of cross-sectional side views to describe individual components of the anchor slip assembly, their geometries, and their interrelationships according to various example configurations. The components of the anchor slip assembly, the extension kit, and other aspects of a well tool are three-dimensional structures with multiple segments or units circumferentially arranged about a mandrel. FIGS. 9 to 11 provide additional views further illustrating the circumferential arrangement of selected components of the anchor slip assembly.

FIG. 9 is a cross-sectional side view of the slip 80 and wedge extender 100 of FIG. 6 (set position) as taken through a central axis 130 of the slip 80. The cross-sectional view reveals the cross-sectional profile of the slip 80 and wedge extender 100 at the top and bottom of the drawing view, with an interior view of the sectioned slip 80 and wedge extender 100 therebetween. The slip 80 may be alternately referred to as a barrel slip in this configuration, given its general barrel-like shape as the profile shown in preceding figures is swept around the central axis 130. The central axis 130 may be in common with central axes of the mandrel 34 and the casing 14 in which the anchor slip assembly 28 may be set. The barrel slip 80 includes a plurality of slip ramp segments 84 circumferentially arranged about the mandrel 34 that collectively at least partially define the slip ramp 82. The wedge extender 100 includes a plurality of wedge extender segments 104 circumferentially arranged about the mandrel 34 and collectively, at least partially defining the inwardly facing ramp 104 for engaging the actuator ramp and the outwardly facing ramp 102 for engaging the slip ramp 82.

In the FIG. 9 configuration of the barrel slip 80, the slip ramp segments 84 are structurally connected by an expandable structure comprising expansion slots 81. The barrel slip 80 may be formed, such as by molding, extruding, forging, or combinations thereof as a unitary structure. The expansion slots 81 may then be formed in the unitary structure, such as using water jetting. As the barrel slip 80 is radially expanded during setting, the expansion slots 81 allow the material of the barrel slip 80 to expand (preferably elastically and non-destructively), so that the slip ramp segments 84 may circumferentially separate from each other at locations along the barrel slip 80 to achieve the radial expansion.

The wedge extender 100 may use a similar expandable construction that includes a plurality of wedge extender segments 104 structurally connected and having expansion slots 101. The wedge extender 100, like the barrel slip 80, may radially expand when setting. That is, as the wedge extender 100 is radially expanded during setting, the expansion slots 101 allow the material of the wedge extender 100 to expand (preferably elastically and non-destructively), so that the wedge extender segments 104 may circumferentially separate from each other to achieve the radial expansion.

FIG. 10 is a perspective view of an alternate configuration of a wedge extender 200. The wedge extender 200 includes an optionally rigid body 202 of circular cross-section for positioning about the central axis 130 of a mandrel. The rigid body 202 defines a plurality of radially-extending tracks 206. Each wedge extender segment 204 is slidably received within a corresponding radially-extending track 206. Thus, each wedge extender segment is radially moveable in a direction "r" within its corresponding track 206. The radial direction "r" is either toward or away from the central axis 130, although this movement is not required to be perpendicular to the central axis 130. For example, the wedge extender segments 204 may move both axially in a directional component aligned with the central axis 130 and radially in another directional component toward or away from the central axis 130. The wedge extender segments 204 collectively, at least partially define the outwardly facing ramp 102 that engages the slip ramp to urge the slip radially outwardly in response to radially outward movement of the wedge extender segments 204.

FIG. 11 is a perspective view of the wedge extender 200 of FIG. 10, with the wedge extender segments 204 urged radially outwardly with respect to the rigid body 202, such as in response to engagement by the actuator ramp 92 as in preceding figures. Thus, the radial expansion of the wedge extender 200 from its position in FIG. 10 to its position in FIG. 11 is due to the radially outward movement of the wedge extender segments 204, to radially expand the slip.

The foregoing example configurations have described not only various mechanical and structural configurations of an anchor slip assembly and settable tool but also steps used in operating the tool and anchor slip assembly. For example, one method of setting a well tool downhole may include disposing the well tool downhole with a wedge extender disposed along a mandrel between an actuatable wedge and a slip. When desired to set the tool, the actuatable wedge may be urged axially under the wedge extender to urge the wedge extender radially outwardly with respect to the mandrel. The wedge extender may also be urged axially under a slip ramp to urge the slip radially outwardly with respect to the wedge extender. The tool may be set in a different range of casing diameters depending on whether the extension kit is installed. For example, the well tool may be set downhole in a well within the first range of casing diameters without the wedge extender, by urging the actuatable wedge axially along the mandrel in direct engagement with the slip ramp to urge the slip radially outwardly with respect to the actuatable wedge. The wedge extender may be used to then set the same well tool in another hole within the second range of casing diameters, such as to set the tool in a greater hole diameter. When using the wedge extender, the wedge extender may be coupled to one of the slip and the actuatable wedge with a shearable pin to control a timing of the step of urging the wedge extender axially under the slip ramp with respect to a timing of the step of urging the actuatable wedge axially under the wedge extender.

Accordingly, the present disclosure provides a well tool and an anchor slip assembly for setting the well tool in any of a variety of hole sizes. A wedge extender may be included with the anchor slip assembly, or as part of an optional extension kit that may also include an additional slip and/or actuator wedge to accommodate the wedge extender. The methods/systems/compositions/tools may include any of the various features disclosed herein, including one or more of the following statements.

Statement 1. A well tool, comprising: a slip disposable about a mandrel and comprising a slip ramp facing radially inwardly and a tubing engagement portion facing radially outwardly; an actuatable wedge disposable about the mandrel and comprising an actuator ramp facing radially outwardly; and a wedge extender axially disposable along the mandrel intermediate the slip ramp and the actuatable wedge, the wedge extender comprising an inwardly facing ramp for slidably engaging the actuator ramp and an outwardly facing ramp for slidably engaging the slip ramp to urge the slip radially outwardly in response to axial movement of the actuatable wedge toward the slip ramp.

Statement 2. The well tool of Statement 1, wherein with the wedge extender removed from the mandrel, the actuator ramp directly slidably engages the slip ramp to urge the slip radially outwardly in response to axial movement of the actuatable wedge toward the slip ramp.

Statement 3. The well tool of Statement 1 or 2, further comprising: the wedge extender including a plurality of wedge extender segments circumferentially arranged about the mandrel and collectively, at least partially defining the inwardly facing ramp for engaging the actuator ramp and the outwardly facing ramp for engaging the slip ramp.

Statement 4. The well tool of Statement 3, wherein the wedge extender segments are structurally connected by an expandable structure comprising expansion slots.

Statement 5. The well tool of Statement 3, further comprising: the wedge extender including a plurality of radially-extending tracks, each track slidably receiving a corresponding one of the wedge extender segments.

Statement 6. The well tool of any of Statements 1 to 5, further comprising: one or both of a first travel stop along an interface between the actuator ramp and the wedge extender limiting slidable engagement therebetween, and a second travel stop along an interface between the slip ramp and the wedge extender limiting slidable engagement therebetween.

Statement 7. The well tool of Statement 6, wherein the first travel stop comprises a projection along the actuator ramp or the inwardly facing ramp of the wedge extender and the second travel stop comprises a projection along the slip ramp or the outwardly facing ramp of the wedge extender.

Statement 8. The well tool of Statement 6 or 7, wherein the first travel stop prevents moving the slip ramp beyond an end of the outwardly face ramp of the wedge extender and the second travel stop prevents moving the actuator ramp beyond an end of the inwardly facing ramp of the wedge extender.

Statement 9. The well tool of any of Statements 1 to 8, wherein a range of sliding engagement between the actuator ramp and the wedge extender is equal to a range of sliding engagement between the slip ramp and the wedge extender.

Statement 10. The well tool of any of Statements 1 to 9, wherein the wedge extender radially extends from a mandrel outer diameter (OD) to a slip inner diameter (ID) in a run-in position.

Statement 11. The well tool of any of Statements 1 to 10, further comprising: at least one shear pin coupling the wedge extender to at least one of the slip and the actuatable wedge.

Statement 12. The well tool of Statement 11, wherein the at least one shear pin comprises a first shear pin coupling the wedge extender to the slip and a second shear pin coupling the wedge extender to the actuatable wedge, wherein the first and second shear pins have different shear strengths.

Statement 13. A high-expansion slip/wedge system, comprising: at least one slip disposable about a mandrel and including a slip ramp facing radially inwardly; at least one actuatable wedge disposable about the mandrel and including an actuator ramp facing radially outwardly, wherein the actuator ramp is configured to urge the slip radially outwardly in response to axial movement of the actuatable wedge in direct engagement with the slip ramp; and a kit comprising a wedge extender removably disposable along the mandrel intermediate one of the at least one slip and one of the at least one actuatable wedge, the wedge extender comprising an inwardly facing ramp for slidably engaging the actuator ramp and an outwardly facing ramp for slidably engaging the slip ramp.

Statement 14. The high-expansion slip/wedge system of Statement 13, wherein the extension kit comprises a second slip interchangeable with the one of the at least one slip, providing additional axial clearance for use with the wedge extender.

Statement 15. The high-expansion slip/wedge system of Statement 13 or 14, wherein the extension kit comprises a long-travel actuatable wedge interchangeable with the one of the at least one actuatable wedge, providing additional axial clearance for use with the wedge extender.

Statement 16. The high-expansion slip/wedge system of Statement 13, wherein the inwardly facing ramp of the wedge extender has a larger engagement area than an engagement area of the slip ramp and the outwardly facing ramp of the wedge extender has a larger engagement area than an engagement area of the actuator ramp.

Statement 17. A method of setting a well tool downhole, comprising: disposing the well tool downhole with a wedge extender disposed along a mandrel between an actuatable wedge and a slip; urging the actuatable wedge axially under the wedge extender to urge the wedge extender radially outwardly with respect to the mandrel; and urging the wedge extender axially under a slip ramp to urge the slip radially outwardly with respect to the wedge extender.

Statement 18. The method of Statement 17, further comprising: disposing the well tool downhole without the wedge extender; and urging the actuatable wedge axially along the mandrel in direct engagement with the slip ramp to urge the slip radially outwardly with respect to the actuatable wedge. For example, the well tool could be set downhole one time without the wedge extender, retrieved to add the wedge extender, and disposed downhole another time, in the same or a different hole, such as in a different hole diameter, with the wedge extender.

Statement 19. The method of Statement 17 or 18, further comprising: setting the well tool in a greater hole diameter when using the wedge extender than when not using the wedge extender.

Statement 20. The method of any of Statements 17 to 19, further comprising: coupling the wedge extender to one of the slip and the actuatable wedge with a shearable pin to control a timing of the step of urging the wedge extender axially under the slip ramp with respect to a timing of the step of urging the actuatable wedge axially under the wedge extender.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A high-expansion slip/wedge system, comprising:

at least one slip disposable about a mandrel and including a slip ramp facing radially inwardly;

at least one actuatable wedge disposable about the mandrel and including an actuator ramp facing radially outwardly, wherein the actuator ramp is configured to urge the slip radially outwardly in response to axial movement of the actuatable wedge in direct engagement with the slip ramp; and a kit comprising a wedge extender removably disposable along the mandrel intermediate one of the at least one slip and one of the at least one actuatable wedge, the wedge extender comprising an inwardly facing ramp for slidably engaging the actuator ramp and an outwardly facing ramp for slidably engaging the slip ramp;

wherein the extension kit comprises a second slip interchangeable with the one of the at least one slip, providing additional axial clearance for use with the wedge extender.

2. The high-expansion slip/wedge system of claim 1, wherein the extension kit comprises a long-travel actuatable wedge interchangeable with the one of the at least one actuatable wedge, providing additional axial clearance for use with the wedge extender.

3. A high-expansion slip/wedge system, comprising:

at least one slip disposable about a mandrel and including a slip ramp facing radially inwardly;

at least one actuatable wedge disposable about the mandrel and including an actuator ramp facing radially outwardly, wherein the actuator ramp is configured to urge the slip radially outwardly in response to axial movement of the actuatable wedge in direct engagement with the slip ramp; and a kit comprising a wedge extender removably disposable along the mandrel intermediate one of the at least one slip and one of the at least one actuatable wedge, the wedge extender comprising an inwardly facing ramp for slidably engaging the actuator ramp and an outwardly facing ramp for slidably engaging the slip ramp;

wherein the inwardly facing ramp of the wedge extender has a larger engagement area than an engagement area of the slip ramp and the outwardly facing ramp of the wedge extender has a larger engagement area than an engagement area of the actuator ramp.

4. The well tool of claim 1 or 3, further comprising:

the wedge extender including a plurality of wedge extender segments circumferentially arranged about the mandrel and at least partially defining the inwardly facing ramp for engaging the actuator ramp and the outwardly facing ramp for engaging the slip ramp.

5. The well tool of claim 4, wherein the wedge extender further comprises:

an expandable structure comprising expansion slots structurally connecting the wedge extender segments, or a plurality of radially-extending tracks, each track slidably receiving a corresponding one of the wedge extender segments.

6. The well tool of claim 1 or 3, further comprising:

one or both of a first travel stop along an interface between the actuator ramp and the wedge extender limiting slidable engagement therebetween, and a second travel stop along an interface between the slip ramp and the wedge extender limiting slidable engagement therebetween.

7. The well tool of claim 1 or 3, wherein a range of sliding engagement between the actuator ramp and the wedge extender is equal to a range of sliding engagement between the slip ramp and the wedge extender.

8. The well tool of claim 1 or 3, wherein the wedge extender radially extends from a mandrel outer diameter (OD) to a slip inner diameter (ID) in a run-in position.

9. The well tool of claim 1 or 3, further comprising:

at least one shear pin coupling the wedge extender to at least one of the slip and the actuatable wedge.

10. The well tool of claim 9, wherein the at least one shear pin comprises a first shear pin coupling the wedge extender to the slip and a second shear pin coupling the wedge extender to the actuatable wedge, wherein the first and second shear pins have different shear strengths.

11. A method of setting a well tool downhole, comprising:

disposing the well tool downhole with a wedge extender disposed along a mandrel between an actuatable wedge and a slip;

urging the actuatable wedge axially under the wedge extender to urge the wedge extender radially outwardly with respect to the mandrel;

urging the wedge extender axially under a slip ramp to urge the slip radially outwardly with respect to the wedge extender;

disposing the well tool downhole without the wedge extender; and urging the actuatable wedge axially along the mandrel in direct engagement with the slip ramp to urge the slip radially outwardly with respect to the actuatable wedge.

12. The method of claim 11, further comprising:

setting the well tool in a greater hole diameter when using the wedge extender than when not using the wedge extender.

13. The method of claim 11, further comprising:

coupling the wedge extender to one of the slip and the actuatable wedge with a shearable pin to control a timing of the step of urging the wedge extender axially under the slip ramp with respect to a timing of the step of urging the actuatable wedge axially under the wedge extender.

* * * * *